United States Patent [19]

Ramillon

[11] 3,936,065

[45] Feb. 3, 1976

[54] SAFETY SKI BINDING

[76] Inventor: René Ramillon, 3, rue Emile Zola 38029, Grenoble & Cedex, France

[22] Filed: Oct. 29, 1974

[21] Appl. No.: 519,002

[30] Foreign Application Priority Data

Oct. 31, 1973 France ..... 73.39464
Apr. 30, 1974 France ..... 74.15818

[52] U.S. Cl. ..... 280/11.35 T
[51] Int. Cl.[2] ..... A63C 9/08
[58] Field of Search ..... 280/11.35 T, 11.35 K

[56] References Cited

UNITED STATES PATENTS

| | | | |
|---|---|---|---|
| 3,241,849 | 3/1966 | Bodycomb | 280/11.35 T |
| 3,504,922 | 4/1970 | Wiley | 280/11.35 T |
| 3,716,248 | 2/1973 | Wiley | 280/11.35 T |
| 3,730,543 | 5/1973 | Edmund | 280/11.35 T |

*Primary Examiner*—Robert R. Song
*Attorney, Agent, or Firm*—Karl F. Ross; Herbert Dubno

[57] ABSTRACT

A safety ski binding for securing a ski boot to a ski having a medium plane extending longitudinally along the center of the ski and perpendicular to the ski comprises a toe boot element on the toe of the ski boot, a heel boot element on the heel of the ski boot, respective toe and heel ski elements secured to the ski at the median plane thereof and lockingly engageable with the toe and heel boot elements, and means for urging one of ski elements along the plane towards the other ski element. One of the toe elements comprises a pair of generally cylindrical and parallel pins flanking the median plane and the other one of the heel elements is a generally cylindrical body lying substantially perpendicular to the plane and formed at the plane with a circumferencial groove and the other heel element is a profiled button lying on said plane and engageable in the groove. The means for urging comprises a piston displaceable along the ski relative to an abutment by a spring braced between the abutment and the piston. The toe and heel elements may be carried on a separate sole plate releasably secured to the bottom of the ski boot, and the toe ski element may be carried on a pivotal support so as to allow the skier readily to release the ski boot from the ski. The spring is biased against the heel ski element so that when the boot is twisted or the toe of the boot is lifted this boot is displaced backwardly against the spring force allowing the toe to free itself from the binding. When the heel of the boot is lifted the grooved cylindrical body compresses the spring and allows the heel to pull free from the heel ski element.

10 Claims, 11 Drawing Figures

SAFETY SKI BINDING

CROSS-REFERENCE TO RELATED APPLICATIONS

This application is related to my copending patent applications Ser. Nos. 418,822 (U.S. Pat. No. 3,873,110) and 480,202 (U.S. Pat. No. 3,892,421) filed on Nov. 26, 1973 and June 17, 1974, respectively.

FIELD OF THE INVENTION

The present invention relates to a safety ski binding. More particularly this invention concerns such a ski binding which automatically releases the ski boot of the skier when this boot is twisted relative to the ski or tipped on the ski with a force exceeding a predetermined maximum safe force.

BACKGROUND OF THE INVENTION

A ski binding for securing a ski boot to a ski usually comprises a toe holddown and a heel holddown. Typically the toe holddown is constructed to pivot to the side and release the front of the skier's boot when this boot is twisted with a torsional force exceeding a maximum safe limit. The heel holddown, on the contrary, is adapted to release the heel of the skier's boot when this heel is lifted up with a force exceeding a predetermined maximum force.

Thus there is associated with each of these holddowns a respective biasing means which must be independently adjusted to control its respective function. The bindings so made are therefore relatively expensive as they are complicated. In addition little protection is provided for a fall backward, as the toe clamp is frequently only arranged to release the toe of the ski boot when this ski boot is twisted on the ski.

OBJECTS OF THE INVENTION

It is therefore an object of the present invention to provide an improved ski binding.

Another object of this invention is the provision of such a binding which is relatively inexpensive to manufacture.

Yet another object is to provide a ski binding which releases the ski boot from the ski when this boot is twisted on the ski or when either the heel or toe of the ski boot is raised from the ski with a force exceeding a predetermined maximum safe force.

A further object is to provide such a ski binding which is of relatively simple construction so as to be adaptable to virtually any type of ski boot, and which can readily be adjusted.

SUMMARY OF THE INVENTION

These objects are attained according to the present invention in a safety ski binding for securing a ski boot to a ski having a median plane extending longitudinally along the center of the ski and perpendicular to the ski. This binding comprises a toe boot element on the toe of the ski boot, a heel boot element on the heel of the ski boot, a toe ski element secured to the ski at the median plane and lockingly engageable with the toe boot element, a heel ski element secured to the ski at the median plane and lockingly engageable with the heel boot element, and means for urging one of ski elements along the plane towards the other ski element. One of the toe elements in accordance with the present invention comprises a pair of generally cylindrical parallel pins flanking the median plane and the other of the toe elements is a profiled button lying on the plane and engageable between the pins. One of the heel elements according to this invention is a generally cylindrical body lying substantially perpendicular to the plane and formed at the plane with a circumferential groove, and the other heel element is a profiled button lying on the plane and engageable in the groove.

Thus in accordance with the present invention a single biasing means is provided which controls the release of the ski boot from the ski both when this ski boot is twisted relative to the ski about an axis lying generally in the ski median plane and perpendicular to the ski, and to release the ski boot when it is tipped either forward or backward relative to the ski.

According to yet another feature of this invention both of the buttons have rounded heads formed as bodies of revolution with a common axis lying in the ski median plane. Thus if the ski is twisted the rounded heat at the toe presses against the two cylindrical pins so as to force that one ski element connected to the urging means away from the ski boot and allow release of the ski. Similarly upward tipping of the heel will similarly tend to displace the ski boot in the median plane and allow this boot to be released.

According to another feature of the present invention a fork pivotal about an axis perpendicular to the median plane carries the toe ski element itself provided with a catch that holds the fork in a position not pivotal about its axis so as to hold the ski boot in place. Release of this catch by the skier allows him to free his boot from the ski.

According to yet another feature of this invention the toe and heel boot elements are carried on a sole plate which is releasably attached to the ski boot. A cable and toggle catch arrangement allows this sole plate to be attached to virtually any type of ski boot so as to allow the ski binding according to the present invention to be adapted to various different boot styles.

BRIEF DESCRIPTION OF THE DRAWING

The above and other objects, features, and advantages will be more readily apparent from the following, reference being made to the accompanying drawing in which.

SPECIFIC DESCRIPTION

Figure 1:
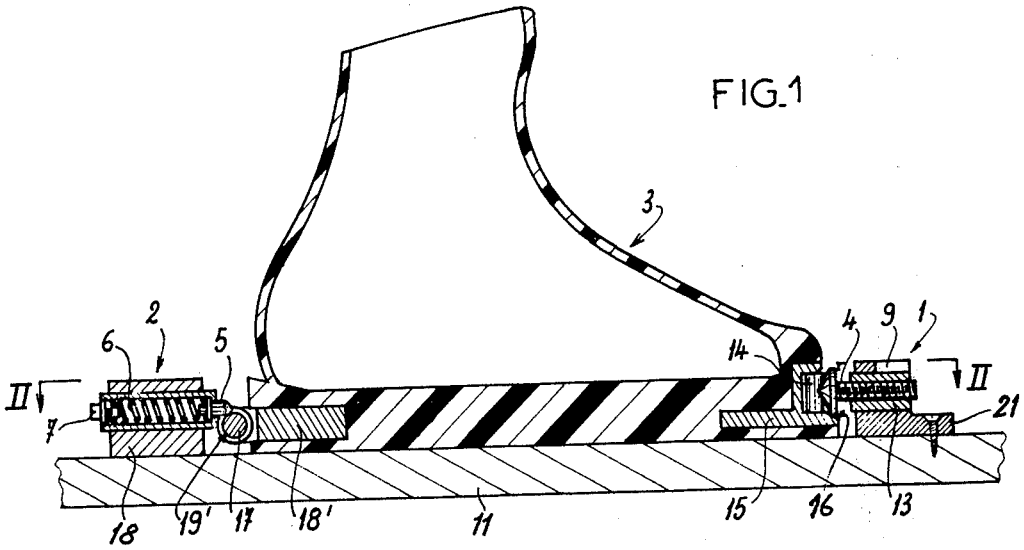
FIG. 1 is a vertical section taken along the median plane of a ski binding according to the present invention.
Figure 2:
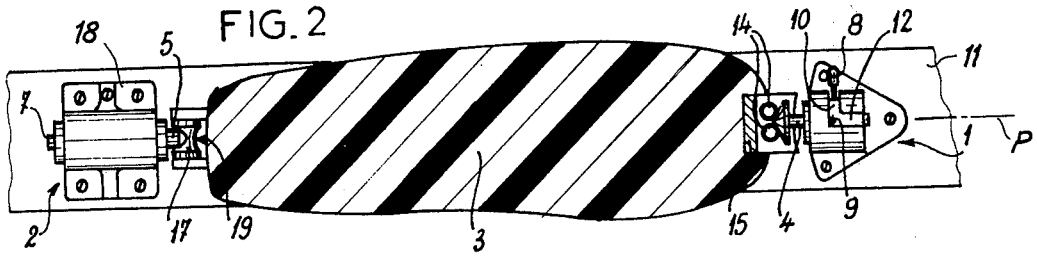
FIG. 2 is a section taken along line II—II of FIG. 1.

As shown in FIGS. 1 and 2 a ski 11 having a median plane P is secured to a ski boot 3 by a toe holddown 1 and a heel holddown 2. A heel holddown button 5 slidable like a piston in a fixed support 18 and urged in the direction of plane P and parallel to the ski by a spring 6 bearing against an abutment plug 7 screwed into the support cylinder 18. Similarly a toe button 4 threaded into a plug 13 axially slidable in a support 21 secured to the ski 11 has a radially projecting locking lever 8 displaceable in an L-shaped groove 9 having a portion 10 extending perpendicular to the plane P and a portion 12 extending parallel to the plane P. FIG. 1 shows how with lever 8 in the portion 10 the button 4 is pressed against the front of the ski boot 3 whereas when retracted in the section 12 this button 4 is out of contact with the ski boot.

The ski boot 3 carries at its toe an anchor block 15 in which are secured a pair of identical pins 14 flanking the plane P and between which engages the conical point of the button 4. The lower edge of the anchor block 15 at the front is formed with a camming surface 16 transverse to the plane P and inclined upwardly and backwardly away from the toe holddown 1.

Another anchor block 18' at the heel of the boot 3 is provided with a generally cylindrical roller 17 formed with a circumferencial groove 19' lying at the plane P so as to give it a generally hyperboloidal shape. The end of the button 5 lies in this groove 19' above the transverse axis of the roller 17.

Thus the ski boot 3 is held securely in place on the ski 11 by the front button 4 engaging between the pins 14 and the rear button 5 engaging over the roller 17.

When the ski boot 3 is subjected to a twist, with the sole of the boot lying in contact with the ski 11, the conical end of the button 4 will press against one of the pins 14 and thereby force the boot 3 back against the button 5 thereby compressing the spring 6. If sufficient torsional force is exerted in either direction the ski boot 3 will be able to move back against the force of spring 6 sufficiently to free the pins 14 from the button 4 and allow the boot to come away from the ski 11. Similarly if the toe of the boot 3 is lifted the camming surface 16 will again drive the boot back against the force of spring 6 and, if the lifting force is sufficient, will allow the toe of the boot 3 to pull upwardly away from the toe holddown 1. If the skier falls forward so as to apply a lifting force at the heel of the ski the button 5 will be driven back against the spring 6 by the roller 17 and, if the force is sufficient, this roller 17 will pull free of the button 5 and allow the boot 3 to come away from the ski. Thus the setting of the plug 7 determines the breakaway force excersisable by the ski boot both in torsion and in lift of either the toe or heel.

Figure 3:
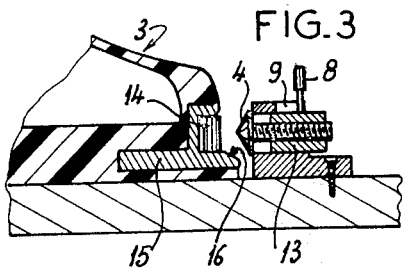
FIG. 3 is a detail view of the toe holddown of the binding shown in FIGS. 1 and 2, in the release position.
Figure 7:
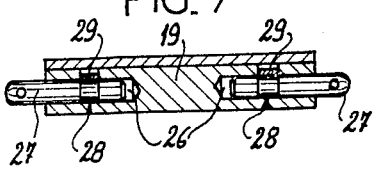
FIG. 7 is a cross section taken along line VII—VII of FIG. 6.
Figure 6:
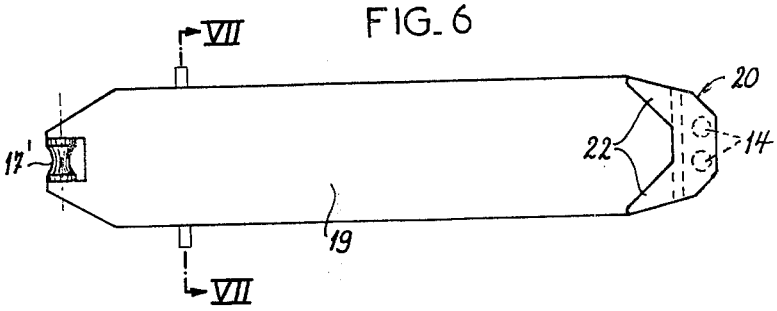
FIG. 6 is a top view of the sole plate shown in FIGS. 4 and 5.
Figure 4:
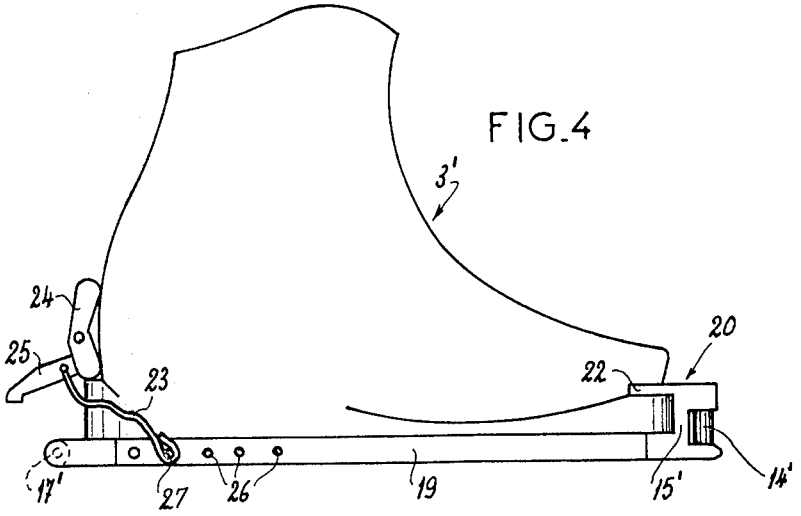
FIG. 4 is a side view of another arrangement in accordance with this invention using a separate sole plate.
Figure 5:
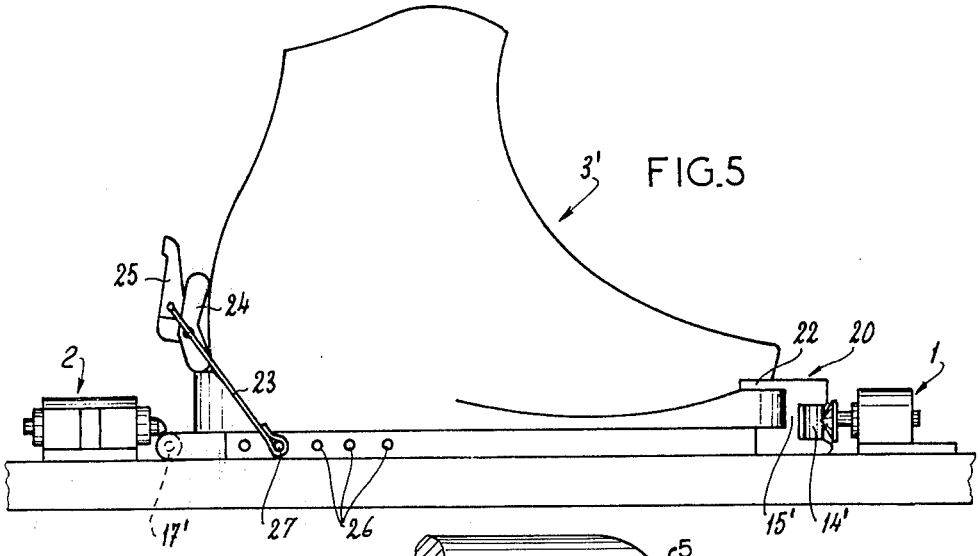
FIG. 5 is a side view of the arrangement shown in FIG. 4 here installed in a binding as shown in FIGS. 1–3.
Figure 1A:
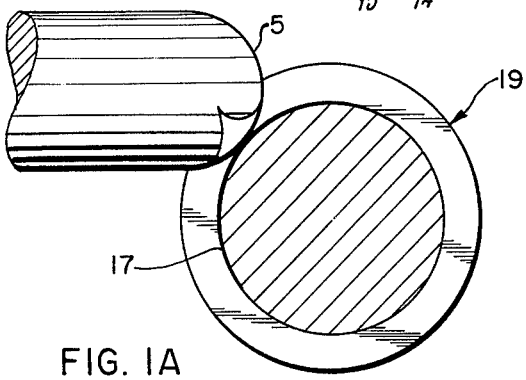
FIG. 1A is a large-scale sectional view of a detail of the ski binding of the present invention.

The device of FIG. 1–3 can also be used with a sole plate 19 as shown in FIGS. 4–7. This plate 19 has at its front end a toe clip 20 formed as a fork with a pair of arms 22 adapted to engage over the toe of a ski boot 3'. This plate 19 is also formed with an anchor region 15' carrying a pair of pins 14' identical to the pins 14 of the FIGS. 1–3. At its rear end the plate 19 carries a roller 17' identical to the roller 17 of FIGS. 1–3.

This plate 19 is secured to the boot 3' by means of a toggle-type locking arrangement comprising a holddown 24 on which is pivoted a toggle lever 25 through which is passed a cable 23 attached at its two ends to pins 27 received in bores 26 in the plate 19. A row of such holes 26 is provided along each side of the plate 19 so as to allow the pins 27 to be secured in that hole giving the best fit of the block 24 atop of the heel part of the sole of the ski boot 3'. To this end the pins 27 are formed with circumferencial grooves 28 in which engage leaf springs 29 when these pins 27 are inserted in the holes 26. Thus it is possible to secure the plate 19 to a boot of virtually any size and allow it thereafter to be readily used with the improved ski binding according to the present invention by simply snapping the pins 27 in the proper holes 26.

Figure 8:
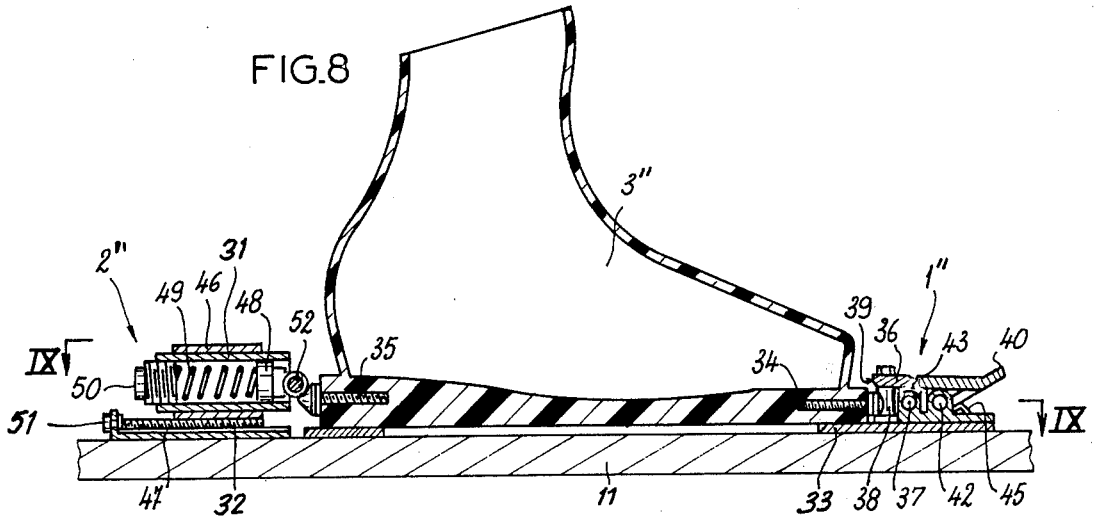
FIG. 8 is a view similar to FIG. 1 of another ski binding according to the present invention.
Figure 9:
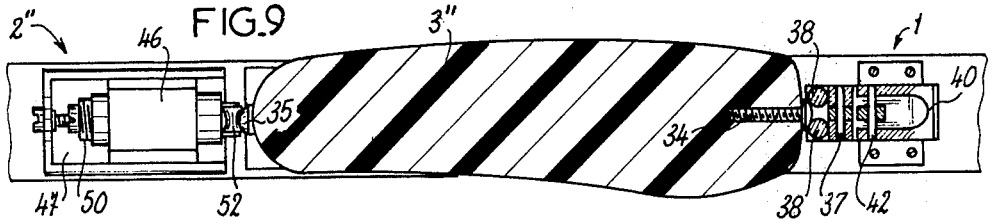
FIG. 9 is a section taken along line IX—IX of FIG. 8.
Figure 10:
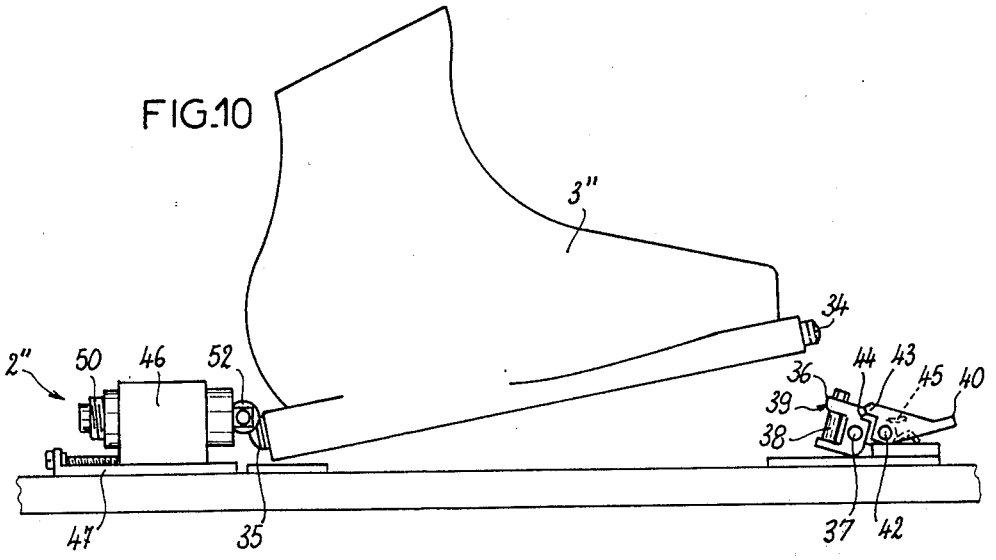
FIG. 10 is a side view of the binding shown in FIGS. 8 and 9, with the ski boot lifted partially free of the ski.

The arrangement shown in FIGS. 8–10 has a pair of coaxial buttons 34 and 35 mounted respectively in the toe and heel of a ski boot 3''. These buttons may be readily fitted to virtually any type of ski boot, it merely being necessary to drill in-line holes in the toe and heel and screw the threaded shank of the buttons 34 and 35 into these holes. The toe holddown 1'' here comprises a support 36 pivotal about an axis 37 perpendicular to plane P and parallel to the upper surface of the ski 11. A pair of pins 38 identical to the pins 14 are mounted on this pivotal support 36 and the upper lip 39 of this support is formed as an inclined camming surface identically shaped to the camming surface 16. A locking dog 40 pivotal on the base 33 of the toe holddown 1'' about an axis 42 parallel to the axis 37 has a rear edge 43 which engages the forward edge of the pivotal support 36 and prevents this support from moving from the position illustrated in FIG. 8. A spring 45 holds the locking dog 40 in the illustrated position, but a deflection of this dog 40 down as shown in FIG. 10 allows the support 36 to pivot backwardly and release the toe button 34.

The heel button 35 is engaged by a hyperboloidal roller 52 carried on a piston 48 slidable in a cylinder 31 carried on a support 46 displaceable along a base 47 by means of a screw 51. A threaded plug 50 is screwed into the rear end of the cylinder 31 allow adjustment of the spring force at the heel holddown 2''. This apparatus functions identically to that of FIGS. 1–3, with the camming surface 39 taking the place of the camming surface 16.

The ski binding according to the present invention is relatively simple and can be produced at extremely low cost. At the same time it can be adjusted simply by means of rotating a single screw or plug. The binding will release the ski boot when this boot is twisted on the ski when the skier falls backward so as to raise the toe, or when the skier falls forward so as to raise the heel. Thus a truly efficient safety binding is provided.

I claim:

1. A safety ski binding for securing a ski boot to a ski having a median plane extending along the center of the ski and perpendicular to the ski, said binding comprising:

a toe boot element on the toe of said ski boot;

a heel boot element on the heel of said ski boot;

a toe ski element secured to said ski at said median plane and lockingly engageable with said toe boot element, one of said toe elements comprising a pair of generally cylindrical and parallel pins flanking said median plane and the other of said toe elements being a profiled button lying in said plane and engageable between said pins;

means coacting between said toe elements for resisting vertical release of the boot from the ski;

a heel ski element secured to said ski at said median plane, and lockingly engageable with said heel boot element, one of said heel elements being a generally cylindrical body having an axis lying substantially perpendicular to said plane and being formed at said plane with a circumferential groove and the other heel element being a profiled button lying in said plane and engaging in said groove in force-transmitting relationship in said plane along said ski; and means for urging one of said ski elements along said plane toward the other ski element whereby a biasing force is applied through said boot elements to said other ski element.

2. The ski binding defined in claim 1 wherein both of said buttons have heads formed as bodies of revolution with a common axis in said plane.

3. The ski binding defined in claim 2 wherein said means for urging includes an abutment fixed on said ski, a piston displaceable along said abutment in said plane toward the other ski element and carrying said one ski element, and a spring between said piston and said abutment.

4. The ski binding defined in claim 3 wherein said heel ski element is carried on said piston.

5. The ski binding defined in claim 4 wherein said one toe element is formed with a camming surface transverse to said plane and inclined upwardly from said ski toward the other toe element, whereby lifting of the toe of said boot forces said other toe element up against said camming surfaces and drives said boot back against said heel ski element.

6. The ski binding defined in claim 5, further comprising a fork pivotal about an axis perpendicular to said plane and carrying said toe ski element, and catch means for holding said fork in a position nonpivotal about its axis.

7. The ski binding defined in claim 6 wherein said toe ski element comprises said pair of pins.

8. The ski binding defined in claim 4, further comprising a sole plate carrying said heel and toe boot elements, and means for securing said plate to the underside of said ski boot.

9. The ski binding defined in claim 8 wherein said means for securing includes a flexible cable having both ends attached to said plate and a toggle catch engaging said cable intermediate said ends and lockingly engageable over said boot.

10. The ski binding defined in claim 4, further comprising means for displacing said toe ski element between a first position pressing against said to boot element and forcing said heel boot element against said heel ski element and a second position spaced from said toe boot element and for locking said toe ski element alternately in either of said positions.

* * * * *